United States Patent [19]

McFarlin

[11] 4,325,220

[45] Apr. 20, 1982

[54] CRYOADSORPTION PUMPS HAVING PANELS WITH ZEOLITE PLATES

[75] Inventor: David J. McFarlin, Ellington, Conn.

[73] Assignee: United Technologies Corporation, Hartford, Conn.

[21] Appl. No.: 194,157

[22] Filed: Oct. 6, 1980

Related U.S. Application Data

[63] Continuation-in-part of Ser. No. 16,263, Feb. 28, 1979, abandoned.

[51] Int. Cl.[3] ..... B01D 8/00

[52] U.S. Cl. ..... 62/55.5; 55/269; 62/268; 165/133; 417/901

[58] Field of Search ..... 62/55.5, 100, 268; 55/269; 417/901; 252/62; 165/133

[56] References Cited

U.S. PATENT DOCUMENTS 3,390,536 7/1968 Kreisman ..... 62/55.5

*Primary Examiner*—Ronald C. Capossela

*Attorney, Agent, or Firm*—C. G. Nessler

[57] ABSTRACT

An improved cryopump has cryopanels with pressed zeolite plates mounted thereon. The plates are maintained in intimate but unbonded contact with the panels by use of spring-type mechanisms. Older style panels have clay-bonded zeolite casts attached to their surfaces. The new configuration allows relative expansion and contraction between the zeolite plates and the panels, thereby improving durability of the zeolite. The resilient attachments assure that intimate contact and consequent good cooling of the zeolite adsorptive surface will be maintained during operation of the pump. The zeolite panels are desirably less than about 8 mm thick and are made by isostatic compaction of powders having pore sizes in the range of $2\text{–}25\times10^{-10}$ m.

3 Claims, 3 Drawing Figures

CRYOADSORPTION PUMPS HAVING PANELS WITH ZEOLITE PLATES

This is a continuation-in-part of application Ser. No. 016,263, filed Feb. 28, 1979 and now abandoned, and is related to Ser. No. 194,161 filed on Oct. 6, 1980.

BACKGROUND ART

This invention relates to zeolite articles, especially those usable as adsorption plates in cryopumps.

The use of zeolite material as a desiccant is well known. Zeolites are complex silicates containing aluminum and one or more other metallic elements, usually sodium, potassium or calcium. Crystals of zeolite typically have a strong affinity for water molecules and usually adsorb water in preference to any other substance. Zeolites also display a somewhat similar preference for certain types of hydrocarbons. See "Molecular Sieves" in Scientific American Magazine, Vol. 200, No. 1, pp. 85–90 (January 1959).

Zeolites are usable for enhancing the pumping action of cryogenic pumps. Such pumps contain a multiplicity of panels through which cryogenic fluid circulates and are disclosed in U.S. Pat. No. 4,207,746 "Cryopump" issued to the inventor herein, the disclosure which is hereby incorporated by reference. The panels are made of a high thermal conductivity metal such as aluminum. A combination of zeolite powder and a clay binder is applied to the surface of the panel in the following manner. A screen or grid-type structure is attached to the panel surface to provide mechanical support. Zeolite powder is mixed with a clay such as kaolin and a solvent to form a slurry which is then applied to the surface of the panel by a technique such as repetitive brushing, spraying, or slip casting. The slurry coated panel is then baked in an oven to drive off the solvent and other volatiles, thereby leaving a zeolite casting affixed to the panel.

In operation a cryopump is reduced to a temperature of 25° K. or lower. To be effective the surface of the zeolite casting must have comparable temperatures. The typical metallic panel and the zeolite casting each have different coefficients of expansion. These produce differential strains at the interface between the casting and the panel surface, which with repetitive use result in damage to the casting. The zeolite material will frequently spall or physically separate from the panel. Obviously, loss of material is disadvantageous; separation disrupts the conductive path between the casting and the panel thereby raising the temperature of the casting and making operation of the pump inadequate. With the present type of materials and construction, periodic inspection and repair of panels must be undertaken.

DISCLOSURE OF INVENTION

An object of the invention is to provide cryopumps with more durable zeolite surfaced cryoadsorptive panels. A further object is to provide cryopanel configurations and attachments with which separately formed zeolite panels can be readily used.

In accord with the invention improved zeolite plates are produced by isostatically cold pressing zeolite powders without the use of any binder. The plates have a very hard, stable structure, high porosity, and may be readily machined. In use a pressed plate is placed in intimate contact with the surface of a metal cryopanel and is thereby cooled to cryogenic temperatures. To achieve a desired temperature of 25° K. or less at the zeolite plate surface in cryopanels cooled by helium, the plate is maintained at a thickness of about 8 mm or less. A plate is constantly held in intimate contact with a panel most preferably by the use of metal springs or other resilient force mechanisms. Since the plate is not bonded to the panel relative movement in the plane of the surface of the panel is possible. Deleterious stresses associated with differential thermal expansions and contractions are avoided. Thus cryopumps with inventive pressed zeolite panels are more durable compared to those with the prior art cast panels.

Cryopumps having panels with pressed zeolite plates thereon pump equally or better than pumps having the cast zeolites of the prior art, while durability and overall performance are increased. Further, cryocondensation pumps (which by design have plain metal panels alone) may be easily converted to cryoadsorption pumps through attachment of the inventive zeolite pressed panels.

The foregoing and other objects, features and advantages of the present invention will become more apparent from the following description of preferred embodiments and accompanying drawings.

BEST MODE FOR CARRYING OUT THE INVENTION

Figure 1:
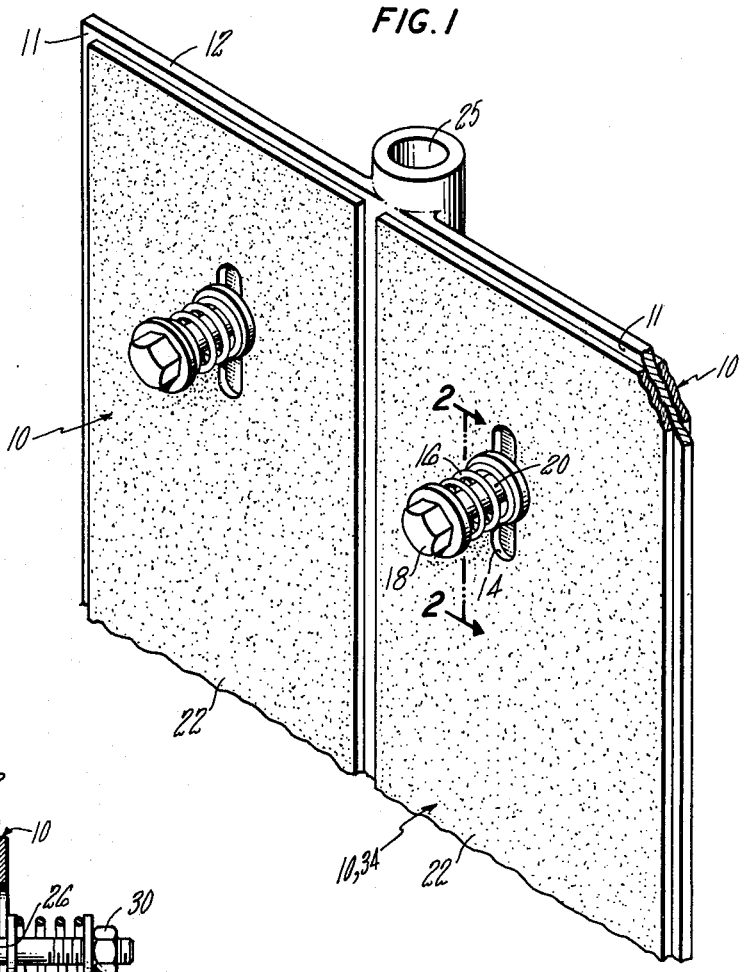
FIG. 1 is a simplified perspective view of a cryopanel having zeolite plates mechanically attached.

The invention is described in terms of the fabrication and use of a rectangular zeolite plate for a cryoadsorption pump. However it will be apparent that the invention will be useful for other applications where structures comprised of zeolite are desirable.

Zeolite powder having a nominal $5\times10^{-10}$ m pore size, such as Linde Type 5Å Molecular Sieve (Union Carbide Corporation, Danbury, Conn.), is first dry pressed to a desired preform shape. As-received powder is evenly placed in a mold made of a metal such as aluminum, constructed in a manner similar to a conventional plunger and ring die for powder compaction. The quantity of powder inserted into the mold is determined by experiment, according to the compaction experienced in the total process and the thickness of the plate which is desired. The powder is compacted within the die at a pressure between 10 and 20 MPa. The pressure is sustained for at least about 1 minute, with 2 minutes being preferred, and other longer times being useful. Room temperature is preferred for convenience although warmer temperatures may be used. The powder is pressed without the use of any binder, as the use of same could interfere with the desired high porosity of the end product. The pressure is at least that which produces a preform with strength sufficient for manual handling; higher pressure may be used but they are unnecessary in view of the next step.

The preform is removed from the dry pressing dies and inserted into a flexible container such as a thin latex bag. The latex container is fitted with a closure and evacuated to a pressure of about 10 kPa, to remove most of the air. Of course, since the zeolite has by nature an affinity for gas by adsorption, there will at the conclusion of the evacuation still be gas contained within the powder. However it is possible and necessary for the next step to achieve the low pressure as indicated.

The container with the preform therein is placed in a pressure vessel containing fluid such as oil at room temperature. Pressure between 200 and 550 MPa is applied to the container for about 5 minutes; a pressure of about 300 MPa is preferred for the Type 5Å powder. The time may be increased and the pressure may be varied interdependently within the range indicated, as needed to produce the desired structure described hereafter. For convenience the pressing process is carried out at room temperature, although warmer temperatures are believed to be usable as well.

Of course the cold pressing is the principal forming process. As evident, to function as cryoadsorption plates and as molecular sieves, pressed zeolite panels must retain their porosity. Thus, to be avoided are any conditions, including excessively high pressure which would tend to block or close porosity beyond whatever unmeasured valve is obtained in our practice. In synopsis the pressure must be sufficient to form an article with a hard, stable structure, but insufficient to cause undue reduction in the high porosity of zeolites. After completion of the isostatic pressing operation, the zeolite article is removed from the latex container and may be then used, or machined to facilitate use, as desired.

A plate formed by the foregoing process can be drilled, sawed, and lightly machined with metalworking tools. The plate surface as formed has a finish determined by the dry pressing dies and isostatic pressing container. This may be improved as desired by grinding. In appearance the final article resembles a substance made from white chalk. The surface is very hard and structurally stable and sound. It is not readily penetrated by light scratching in contrast to the condition it had after the dry pressing step, and in contrast to ordinary ceramics after cold pressing.

Referring again to the details of the process, while the first dry pressing step is preferred to preform the shape which is desired, it may be eliminated. More roughly shaped articles may be simply formed directly in latex containers. Alternately, containers which have more dimensional stability, such as strengthened rubber bags or lightweight metal containers, may be utilized to shape the powder properly as it is placed in the isostatic press. In the preforming and isostatic pressing due adjustment is made in the mold or container shape and powder quantity, to achieve the final dimensions sought. Zeolite powders ranging from $2\text{–}25\times10^{-10}$ m pore size are usable for forming plates suitable for cryopumps. In the practice of the invention as set forth above, plates of about $6\times100\times250$ mm were fabricated by the steps of dry pressing and isostatically pressing set forth above. After this process was completed, the plates had sufficient flatness to permit their attachment to a flat metal cryopanel as described below. Larger plates may be made, and if found to be not flat, may be machined to provide a flat surface.

While it is not necessary to have a binder, it is within contemplation that a binder or other addition may be added to the pressed panel to enhance certain properties such as strength. Obviously, the prior art cast plates are usable in combination with a binder. Thus, it is surmisable that small quantities of binders or additives would not unduly impede the functioning of pressed plates.

Figure 2:
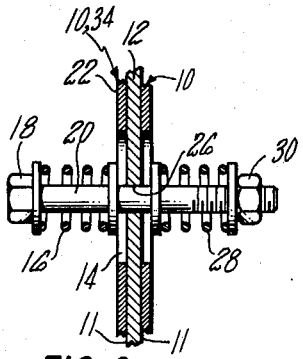
FIG. 2 is a cross section of the attachment portion shown in FIG. 1.
Figure 3:
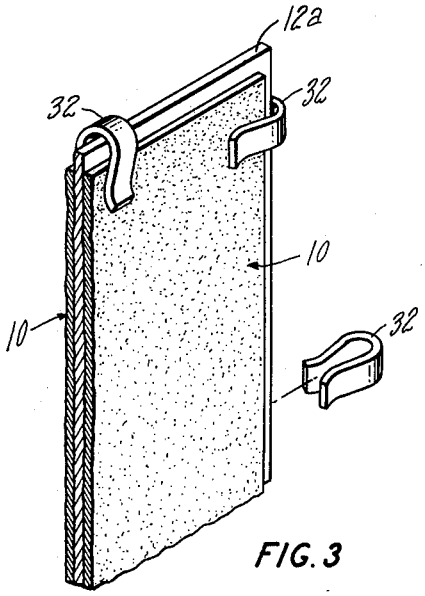
FIG. 3 is a perspective view of a portion of a cryopanel having zeolite plates held in position by spring clips.

FIGS. 1–3 illustrate the use of zeolite plates on cryopump panels. In FIG. 1 a panel 12 has surfaces 11 upon which plates 10 are mounted. The panel has a coolant passage 25 through which a refrigerant is passed for cooling of the panels by conduction. The preferred method of attaching a plate 10 to a panel 12 is illustrated for one of the plates in FIG. 1. The plate has an elongated hole 14 which is either molded into the plate or machined into it after molding. A bolt 20 secures the plate 10, 34 to the panel through compression of a spring 16 captured by the bolt head 18. In the case of panels on opposing sides of the plate, the bolt may extend through a hole 26 in the panel as shown in FIG. 2. The bolt 20 has a head 18 and a nut 30 on opposing sides of the panel. Captured along a bolt on opposite sides of the panel are springs 16, 28. A single spring on one side only would function adequately as well. As typically illustrated by the fastening of the plate 10, 34 the spring 16 presses on the surface 22 of the plate. Thereby the opposing surface of the plate 10, 34 is caused to maintain intimate contact with a surface 11 of the panel 12. Because of the spring action, expansion and contraction of the plates and panel along the length of the bolt are readily accommodated. Furthermore, since the springs are appropriately tensioned to a force which provides intimate contact but still allows frictional movement between the panel and the plate in the plane of the surface 11, there is an absence of significant strain attributable to differential thermal expansion or contraction between the elements. Good heat transfer is achieved by the intimate contact between the plate and the panel and the surface 22 of the plate, which is exposed within a cryopump to the atmosphere. The surface 22 is both cooled and adsorptive of gases, thereby effecting the pumping action for which the cryopump is intended.

An alternate means for attaching plates to panels is illustrated by FIG. 3. Plates 10 are disposed on either side of the panel **12*a* and spring clips 32** are provided around the periphery of the plate and panel. It will be evident to the mechanical designer of ordinary skill that other means of resiliently attaching the plates to the panels may be used. It also should be evident that the plates may be independently attached and that all surfaces of the cryopanel need not have plates thereon. Preferably the plates are made to a relatively small dimension, to avoid problems of getting intimate surface compliance between the panels and the plates, as might occur when large plates are fabricated, or when there are surface deviations on large panels.

Pressed plates are fabricable, at least in thicknesses exceeding 4 mm. In cryoadsorption pumps the surface of a zeolite plate must be maintained at least below 20° K. and lower temperatures are preferred. Typically, a helium coolant will have a temperature in the 4°–10° K. range. Due to conductive path thermal gradient from the coolant passage 25 through the panel 12, a panel surface 11 will have higher temperatures. There is also an interface temperature gradient between the zeolite plate and the panel. There is a further gradient through the thickness of the zeolite panel, which is dependent of the zeolite composition and degree of compaction. Based on these considerations, for cryopanels of common configurations which are presently known, the zeolite panels ought to be maintained at thicknesses of 8 mm or less thickness. In summary, useful pressed plates at 4–8 mm thick.

Although this invention has been shown and described with respect to a preferred embodiment, it will be understood by those skilled in the art that various changes in form and detail thereof may be made without departing from the spirit and scope of the claimed invention.

I claim:

1. Assembly for a cryoadsorption pump comprised of a high thermal conductivity metal panel adapted for cooling by a cryogenic fluid;

the metal panel having mounted thereon a zeolite plate in intimate but unbounded contact;

the zeolite plate made by a process which includes isostatically pressing powder having a poor size between $2\text{–}25\times10^{-10}$ m; and means for resiliently maintaining contact between the panel and the plate.

2. The assembly of claim 1 wherein plates are attached on opposing sides of the cryopanel, each plate having at least one through hole, and wherein the resilient means are comprised of at least one bolt passing through the panel and plates, the bolt capturing within its length a spring.

3. The assembly of claim 1 wherein the resilient means are comprised of spring clips around the periphery of the cryopanel.

* * * * *

UNITED STATES PATENT AND TRADEMARK OFFICE

CERTIFICATE OF CORRECTION

PATENT NO. : 4,325,220

DATED : April 20, 1982

INVENTOR(S) : David J. McFarlin

It is certified that error appears in the above—identified patent and that said Letters Patent is hereby corrected as shown below:

Column 5, line 15 "unbounded" should be --unbonded--

Column 6, line 2 "poor" should be --pore--

Signed and Sealed this

*Twenty-fourth* Day of *August 1982*

[SEAL]

*Attest:*

GERALD J. MOSSINGHOFF

*Attesting Officer*

*Commissioner of Patents and Trademarks*